United States Patent [19]

Schiek et al.

[11] 4,195,271

[45] Mar. 25, 1980

[54] BROAD-BAND 180° PHASE SHIFTER

[75] Inventors: Burkhard Schiek; Jürgen Köhler, both of Halstenbek, Fed. Rep. of Germany

[73] Assignee: U.S. Philips Corporation, New York, N.Y.

[21] Appl. No.: 851,440

[22] Filed: Nov. 14, 1977

[30] Foreign Application Priority Data

Nov. 26, 1976 [DE] Fed. Rep. of Germany ..... 2653676

[51] Int. Cl.[2] ..... H01P 3/08; H01P 1/18; H01P 9/00

[52] U.S. Cl. ..... 333/161; 333/245; 333/246

[58] Field of Search ..... 333/31 R, 31 A, 84 R, 333/84 M, 97 R, 73 S, 82 R, 82 A, 28 R, 18, 156, 161, 245, 246, 204, 116

[56] References Cited

FOREIGN PATENT DOCUMENTS 2460695 7/1976 Fed. Rep. of Germany ..... 333/31 R

OTHER PUBLICATIONS

Pregla- "Meander Lines for Delay Equalization", Conference on Trunk Telecommunications by Guided Waves, London, England, 1970; pp. 171-175.

*Primary Examiner*—Alfred E. Smith
*Assistant Examiner*—Marvin Nussbaum
*Attorney, Agent, or Firm*—Algy Tamoshunas

[57] ABSTRACT

Disclosed is a 180° phase shifter having meander-shaped coupled lines in a predominantly planar form, such as, for example, microstrip, microslot or stripline, formed by a λ/2 long meander disposed opposite to a λ/4 long meander.

4 Claims, 4 Drawing Figures

BROAD-BAND 180° PHASE SHIFTER

The invention relates to a 180° phase shifter having meander-shaped coupled lines in predominantly planar form, such as, for example, microstrip, microslot or strip line. Such phase shifters can be used instead of all-pass filters whose phase difference at the output is approximately 180° over a wide frequency range when they are controlled with an equal phase. Broad-band, fixedly adjusted, 180° phase shifters are furthermore widely used in the microwave circuit technology. A 180° phase shifter combined with a power divider can, for example, be used as balum for the control of antennas. In addition, the combination of power divider and 180° phase shifter can be used for exciting ground symmetrical lines, as, for example, required for the control of broad-band balanced mixers.

An article by B. M. Schiffman, entitled, "A New Class of Broad-Band Microwave 90-Degree Phase Shifters", "IRE TRANSACTIONS ON MICROWAVE THEORY AND TECHNIQUES, Apr. 1958, pp, 232-237 etc."discloses a 90° phase-shifter with coupled lines (meanders) which are connected at one end. A strip line in which the two λ/4 meanders are arranged sequentially results in a 180° phase shifter, the necessary reference line having a length of 3/2 λ.

180° phase shifters can also be formed by a λ/4-meander and a reference line having a length λ. In these cases, however, the coupling of the meanders must be of a tightness which cannot be obtained in planar technique.

Also with a λ/2-long meander for which the length of the reference line is likewise λ/2, the required coupling of the meander would have to be markedly tighter than as can be realized by in planar techniques in order to obtain a broad-band phase shifter.

It is an object of the invention to provide, in planar technique, the couplings which are required for broad-band 180° phase shifters.

This object is accomplished by forming the differential phase shifter from a λ/2-long meander and a λ/4-long meander which are opposite one another in coupled lines.

Advantageously one meander is formed by (n+1) λ/4-sections and the reference meander is formed by nλ/4-sections, n being an integer.

As the coupled lines have a length of approximately a quarter or half a wavelength, respectively, an implementation especially in the microwave range can be easily effected.

The drawing shows embodiments, wherein.

Figure 1:
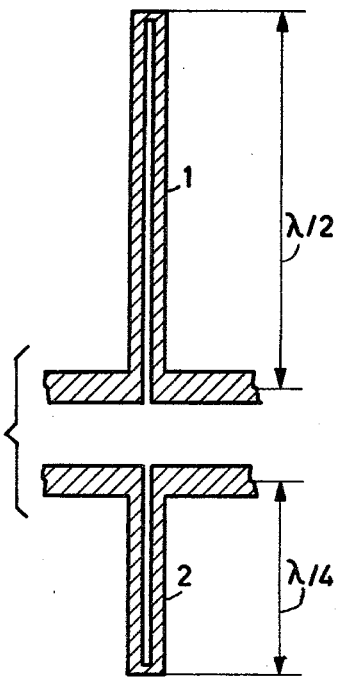
FIG. 1 shows a phase shifter having λ/4 and λ/2 meanders.
Figure 2:
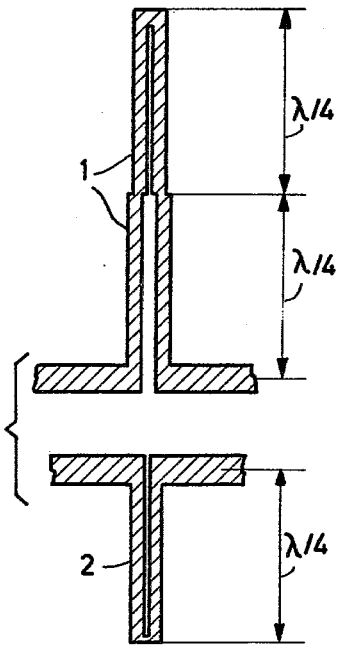
FIG. 2 shows a phase shifter having λ/2 meanders formed by two λ/4 sections

In accordance with FIG. 1 the λ/2-long meander 1, formed by a pair of microstrip lines connected at one end. The λ/2 meander is positioned opposite a λ/4-long meander of a reference line 2. The reference line 2 is likewise in the form of a meander formed by a pair of coupled lines connected at one end. It appeared that the coupling which is now required is considerably less and can be realized by planar techniques. To optimize the phase-variation over a given bandwidth it is advantageous, in accordance with FIG. 2, to construct the λ/2 meander of line 1 from two λ/4 sections S1 and S2 of different dimensions and impedances, respectively.

As is known, the meanders can be matched independent of the frequency when the in-phase and 180° out-of-phase waves on the meander have equal phase velocities. This is also the case with strip lines. In many line structures such as, for example, microstrip and microslot, there is a great difference between the phase velocities of the in-phase and 180° out-of-phase waves. Therefore, it proved to be efficient to form the impedance of the in-phase and out-of-phase wave on the meanders in compound line portions with different dimensions in such a way that matching is guaranteed.

Figure 3:
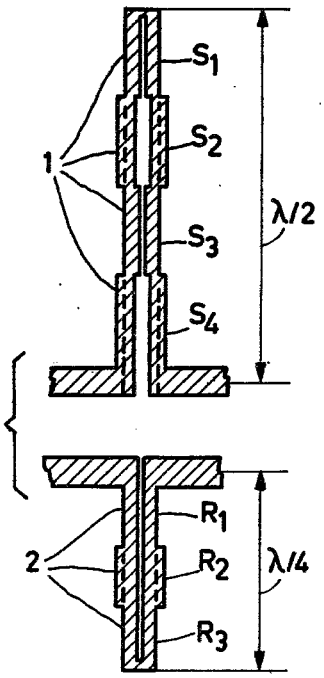
FIG. 3 shows a phase shifter formed from differently dimensioned line portions

Such circuit thus has, for example, a structure as shown in FIG. 3. In this example, the λ/2 meander of the line 1 is divided into four sections S1, S2, S3, and S4 each having of a different impedance or different dimensions. The individual sections have a length of λ/8.

The λ/4 meander of line 2 is divided into three sections R1, R2, and R3. With an optimum choice of the dimensions such an arrangement enables broad-band matching of the meanders, even when the phase velocities of the in-phase and out-of-phase waves are not equal.

Figure 4:
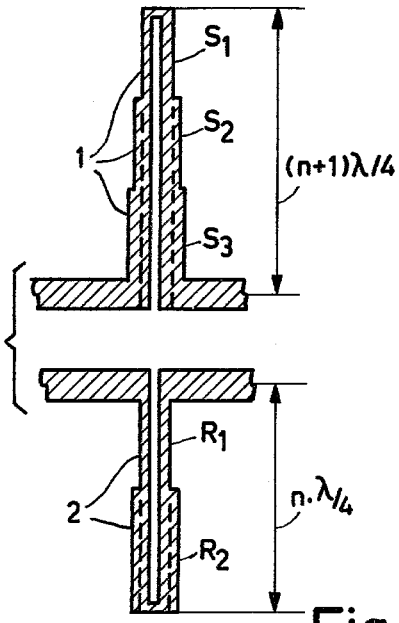
FIG. 4 shows a further modification of a phase shifter formed from differently dimensioned line portions.

Finally, as shown in FIG. 4, it is also possible to construct the meander of line 1 from (n+1) λ/4 sections S1 . . . and the meander of the reference line 2 from n λ/4 sections R1 . . . , n being an integer. A further subdivision is also possible in this case.

What is claimed is:

1. A 180° phase shifter for use in planar microwave circuits such as microstrip, microslot, striplines and the like, said phase shifter comprising a first transmission line having a λ/2 long meander formed by a pair of coupled lines connected at one end and a reference transmission line having a λ/4 long meander formed by a pair of coupled lines connected at one end disposed opposite said λ/2 long meander so that the phase of a signal applied to said first transmission line is shifted by approximately 180° with respect to the phase of a signal applied to said reference transmission line.

2. A phase shifter according to claim 1, wherein said λ/2 long meander is formed by two λ/4 long sections of different impedances.

3. A phase shifter according to claim 1, wherein said λ/2 and λ/4 meanders each include a plurality of sections having different impedances.

4. A 180° phase shifter for use in planar microwave circuits such as microstrip, microslot, striplines and the like, said phase shifter comprising a first transmission line having a first (n+1) λ/4 long meander formed by a pair of coupled lines connected at one end and a second transmission line having a n λ/4 long meander formed by a pair of coupled lines connected at one end disposed opposite said first meander, where n is an interger, so that the phase of a signal applied to said first transmission line is shifted by approximately 180° with respect to the phase of a signal applied to said reference transmission line.

* * * * *